US010408526B2

(12) United States Patent
Lokhande et al.

(10) Patent No.: US 10,408,526 B2
(45) Date of Patent: Sep. 10, 2019

(54) COMPRESSOR MOUNTING BASE PLATE

(71) Applicant: Dow Global Technologies LLC, Midland, MI (US)

(72) Inventors: Ashishkumar S. Lokhande, Pune (IN); Onkareshwar V. Bijjargi, Pune (IN); Nilesh R. Tawde, Mumbai (IN); Gulab N. Malunjkar, Pune (IN)

(73) Assignee: Dow Global Technologies LLC, Midland, MI (US)

( * ) Notice: Subject to any disclaimer, the term of this patent is extended or adjusted under 35 U.S.C. 154(b) by 19 days.

(21) Appl. No.: 15/308,462

(22) PCT Filed: May 15, 2015

(86) PCT No.: PCT/US2015/030927
§ 371 (c)(1),
(2) Date: Nov. 3, 2016

(87) PCT Pub. No.: WO2015/175857
PCT Pub. Date: Nov. 19, 2015

(65) Prior Publication Data

US 2017/0051965 A1 Feb. 23, 2017

(30) Foreign Application Priority Data

May 16, 2014 (IN) ..... 2438/CHE/2014

(51) Int. Cl.
*F25D 23/00* (2006.01)
*F25D 21/14* (2006.01)

(52) U.S. Cl.
CPC ..... *F25D 23/006* (2013.01); *F25D 21/14* (2013.01); *F25D 2400/38* (2013.01)

(58) Field of Classification Search
CPC ..... F25D 23/006; F25D 21/14; F25D 2400/38
See application file for complete search history.

(56) References Cited

U.S. PATENT DOCUMENTS 3,785,167 A * 1/1974 Sahs ..... F25D 23/006 417/312
4,471,633 A 9/1984 Tinsler
(Continued)

FOREIGN PATENT DOCUMENTS

JP 2013-019607 A 1/2013

OTHER PUBLICATIONS

PCT/US2015/030927, International Search Report and Written Opinion dated Jul. 31, 2015.
(Continued)

*Primary Examiner* — Emmanuel Duke

(57) ABSTRACT

An elongated non-metal, corrosion resistant compressor mounting base plate structure useful for an appliance such as a refrigerator unit including (I) a base plate having a top surface and a bottom surface, wherein the base plate is adapted for receiving a compressor on the top surface of the base plate; (II) a means for receiving and removably affixing a compressor to the top surface of the base plate; and (III) a reinforcement means integral with said base plate; wherein said reinforcement means includes, for example, at least two elongated transverse tubular reinforcement segments integral with the base plate segment, one transverse tubular reinforcement segment at each of the transverse ends of the base plate segment; said reinforcement means being adapted for providing the base plate with sufficient strength and rigidity such that the base plate can withstand the deformation load from the weight of the compressor.

15 Claims, 7 Drawing Sheets

(56) References Cited

U.S. PATENT DOCUMENTS

| | | | | |
|---|---|---|---|---|
| 4,490,990 | A | 1/1985 | Chastine et al. | |
| 4,539,737 | A * | 9/1985 | Kerpers | F25D 23/006 248/671 |
| 4,920,696 | A * | 5/1990 | Mawby | F25D 23/006 248/674 |
| 5,711,162 | A * | 1/1998 | Wolanin | F16M 11/42 29/513 |
| 5,913,892 | A * | 6/1999 | Kwon | F16F 15/046 248/624 |
| 6,341,830 | B1 | 1/2002 | Chun | |
| 7,056,796 | B2 | 6/2006 | Wu | |
| 7,168,260 | B2 | 1/2007 | Lee et al. | |
| 7,325,412 | B2 * | 2/2008 | Yun | A47B 91/022 248/188.4 |
| 2005/0257552 | A1 * | 11/2005 | Yun | F25D 23/006 62/295 |
| 2005/0265857 | A1 * | 12/2005 | Lee | F04B 39/0044 417/363 |
| 2005/0279895 | A1 * | 12/2005 | Lee | A47B 91/04 248/188.8 |
| 2008/0145595 | A1 | 6/2008 | Pratt et al. | |
| 2010/0181883 | A1 | 7/2010 | Kim et al. | |
| 2015/0292791 | A1 | 10/2015 | Lokhande et al. | |
| 2016/0201973 | A1 | 7/2016 | Lokhande et al. | |

OTHER PUBLICATIONS

PCT/US2015/030927, International Preliminary Report on Patentability dated Nov. 22, 2016.

* cited by examiner

--Prior Art--

--Prior Art--

--Prior Art--

--Prior Art--

--Prior Art--

COMPRESSOR MOUNTING BASE PLATE

FIELD

The present invention relates to a compressor mounting base plate; and more specifically, the present invention relates to a non-metal, corrosion resistant compressor mounting base plate for an appliance such as a refrigerator, and a process for manufacture the compressor mounting base plate.

BACKGROUND

Original equipment manufacturers (OEMs) that manufacture appliances such as refrigerators are aspiring to shift from the OEMs' current convention design practice of steel stamped parts such as refrigerator parts to new technologies in designing and manufacturing of such refrigerator parts. The current trend in the home appliance industry is moving toward a wall-mounted refrigerator which will prompt OEMs to make such products lighter. For example, OEMs are looking to replace the current steel compressor mounting plate (which is 1-2 kg in weight) of a current refrigerator with a light weight and a non-corrosive composite material compressor mounting base plate.

Generally, the lower portion or bottom structure of an appliance such as a refrigerator contains a machine compartment, a compressor, and a compressor mounting base plate for attaching the compressor to the base plate. A compressor mounting base plate is positioned under the rear part of the refrigerator bottom so as to define a machine compartment and the compressor mounting base plate supports a compressor mounted on the base plate located in the machine compartment.

FIGS. 1 and 2 show a conventional design of a refrigerator, generally indicated by numeral 10, illustrating some of the conventional parts of a refrigerator including a conventional steel compressor mounting base plate 11 affixed to the bottom portion of the refrigerator cabin 12 at a lower portion of a refrigerator cabin; and a conventional compressor 13 affixed to the top surface of the compressor mounting base plate 11. The compressor 13 is attached to the top surface of the compressor mounting base plate 11 via threaded bolts 14 and threaded nuts 15; and compressor support member brackets 16 attached to the compressor 13. Disposed in-between the brackets 16 and the surface of the compressor mounting base plate 11 are vibration damping members 17 for attenuating the vibrations of the compressor when the compressor is in operation. In addition, wheels 18 are attached to the compressor mounting base plate 11 to provide movement of the refrigerator when the compressor mounting base plate 11 is affixed to the refrigerator cabin 12.

FIGS. 3-5 illustrate another example of a conventional steel compressor mounting base plate in the form of a rectangular-shaped tray member generally indicated by numeral 20 which can be affixed to the bottom portion of a refrigerator unit of the prior art (not shown) and which is also adapted for receiving and affixing a conventional compressor (not shown) to the top surface of the compressor mounting base plate 21.

A typical compressor mounting plate of the prior art, as shown in FIGS. 3-5, is made from 1 millimeter (mm) thick steel sheets. The compressor mounting plate is usually manufactured using a sheet metal stamping process to form a compressor mounting base plate 21 having a top surface 22 and a bottom surface 23. Integral with the base plate 21 are longitudinal sidewalls 24 and transverse sidewalls 25 forming a tray member 20. A secondary operation is typically used in the manufacturing process of the compressor mounting base plate to form flange tabs 26, flange holes 27, orifices 28, and orifices 29 in the sheet (see FIGS. 3 and 4). Typically, the finished steel compressor mounting plate part is about 1.2 kilograms (kg) in weight.

The compressor mounting base plate 21 contains a plurality of orifices, typically four orifices 29, for receiving a threaded bolt 31 and a threaded nut 32 (for purposes of illustration, one orifice 29 is shown in FIGS. 3 and 4 without nuts and bolts). The threaded bolts 31 and nuts 32 are used to affix a compressor (not shown) to the compressor mounting base plate 21. A rubber damper member 33, shown in FIGS. 3-5, is inserted between the bolt and nut to providing damping during operation of the compressor. The compressor is attached to the top surface 22 of the base plate to attach to the compressor mounting base plate via a bracket member (similar to bracket 16 of FIGS. 1 and 2). Wheels 34 rotatably affixed to the compressor mounting base plate 21 are used to install the compressor mounting base plate into the refrigerator unit.

When the steel compressor mounting plate of the prior art is subjected to a corrosive environment, over time, the conventional steel compressor mounting plate corrodes and loses its strength. Also, the structural damping coefficient for steel is approximately 2 percent (%) which causes vibrations to transfer to the refrigerator cabin through the compressor mounting plate even though there are typically four rubber dampers fixed with bolts and nuts on the steel sheet compressor mounting plate 21 (for example see damping means including rubber dampers 33 secured to the steel sheet by bolts 31 and nuts 2 shown in FIGS. 3-5) below the location of where the compressor support member brackets will be positioned (for example see brackets 16 of FIGS. 1 and 2).

Thus, OEMs in the home appliance industry are continually seeking appliance equipment and parts such as a compressor mounting base plate product for a refrigerator unit that would provide an improvement to the overall manufacture and cost of an appliance such as a refrigerator unit.

SUMMARY

The present invention includes a compressor mounting base plate structure and design for an appliance device which uses a compressor; a motor; or an equivalent vibrating (reciprocating/rotating) apparatus such as a washing machine, a dishwasher, an air-conditioning unit, or a refrigerator unit. The compressor mounting plate exhibits beneficial characteristics which can also be critical customer requirements. For example, the compressor mounting base plate of the present invention can be light weight such that the compressor mounting base plate is from about 20% to about 30% lighter than a steel plate. The compressor mounting base plate of the present invention also can be advantageously manufactured from a non-metal, non-corrosive composite material such as for example a polyurethane polymer.

In one preferred embodiment, for example, the compressor mounting base plate of the present invention includes an elongated non-metal, corrosion resistant compressor mounting base plate structure useful for an appliance such as a refrigerator unit including:

(I) a base plate segment having a top surface and a bottom surface, wherein the base plate segment is adapted for receiving a compressor on the top surface of the base plate segment;

(II) a means for receiving and removably affixing a compressor to the top surface of the base plate segment; and (III) a reinforcement means integral with said base plate segment; wherein said reinforcement means includes at least two elongated transverse tubular reinforcement segments integral with the base plate segment, one transverse tubular reinforcement segment at each of the transverse sides or ends of the base plate segment generally opposite each other in mirror image and generally parallel to each other along the transverse plane of the base plate segment; said reinforcement means being adapted for providing the base plate with sufficient strength and rigidity such that the base plate can withstand a deformation load from the weight of the compressor; and wherein the compressor mounting base plate structure comprises a non-metal, non-corrosive structure.

The compressor mounting base plate of the present invention made from a composite material has several advantages over a conventional compressor mounting base plate made from a metal such as steel. For example, the composite-based compressor mounting base plate structure of the present invention: (1) is light weight and up to about 30% lighter in weight compared to a steel compressor mounting base plate; (2) is strong as a steel compressor mounting base plate; (3) exhibits no corrosion because the composite-based compressor mounting base plate of the present invention is made of a non-corrosive material such as a polyurethane polymer; (4) exhibits increased dynamic response under compressor loading conditions which is beneficial to restrict mechanical vibrations of the compressor during operation in an appliance device such as a refrigerator; and (5) is easily integrated into conventional parts of various appliance devices such as a conventional refrigerator.

Another aspect of the present invention includes a process for manufacturing the compressor mounting base plate having the above described advantages. In one preferred embodiment for example, the process for manufacturing the compressor mounting base plate may include a pultrusion process.

BRIEF DESCRIPTION OF THE DRAWINGS

For the purpose of illustrating the present invention, the drawings show a form of the present invention which is presently preferred. However, it should be understood that the present invention is not limited to the embodiments shown in the drawings. In the following Figures, like numbers are used to indicate like elements in the Figures.

DETAILED DESCRIPTION

Figure 1:
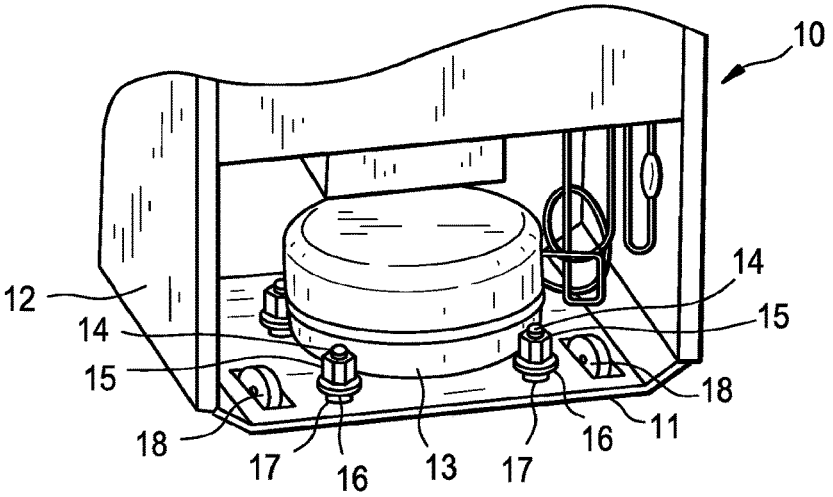
FIG. 1 is a perspective view of a back side lower portion of a refrigerator of the conventional art showing some of the parts of a refrigerator including a machine compartment of a refrigerator containing a steel compressor mounting plate of the conventional art installed in the lower portion of the refrigerator, and a compressor of the conventional art mounted on the steel compressor mounting base plate.

"Light weight", with reference to a composite compressor mounting base plate, herein means a reduced mass of the composite compressor base plate compared to a conventional steel compressor mounting base plate which typically can weigh from 1 kg to 2 kg in weight.

"Dynamic response", with reference to a compressor mounting base plate, herein means the required dynamic stiffness of the compressor mounting base plate sufficient for the compressor mounting base plate to sustain and to isolate vibration of a compressor while providing the required stiffness of the compressor mounting base plate sufficient for the compressor mounting base plate's operation.

"Strong", with reference to a compressor mounting base plate, means the required static stiffness of the compressor mounting base plate sufficient for the compressor mounting base plate to contain/withstand the mass of a compressor.

The composite compressor mounting base plate of the present invention has been developed keeping in mind the above problems occurring in the prior art.

A compressor and a compressor mounting base plate are typically used in refrigerators. A compressor used in refrigerators is an apparatus for compressing a low temperature/low pressure refrigerant into a high temperature/high pressure refrigerant and discharging the high temperature/high pressure refrigerant therefrom. After the discharged refrigerant is heat-radiated to an atmosphere and is changed into the low temperature/low pressure refrigerant via an expansion unit, the low temperature/low pressure refrigerant absorbs heat from inside of the refrigerator.

While the compressor is operated, vibration is generated from the compressor; and the generated vibration is transmitted to other elements of the refrigerator connected to the compressor without damping, thereby causing a noisy vibration to be generated from the whole of the refrigerator through each element of the refrigerator connected to the compressor. Therefore, one objective of the present invention is to provide a compressor mounting base plate structure that advantageously prevents, reduces or attenuates the transmittance of the vibration generated from the compressor through the compressor mounting base plate structure supporting the compressor and to the other elements of an appliance device such as a refrigerator's main body and frame.

A compressor, used in appliance devices such as refrigerators, also commonly operates in a corrosive environment due to the moisture created by condensation in a machine compartment casing of the refrigerator where the compressor is located. Therefore, another object of the present invention is to provide a compressor mounting base plate structure that is made of a non corrosive synthetic resin material, i.e., a thermosetting composite material.

Another object of the present invention is to provide a compressor mounting base plate structure that is sufficiently strong and capable of withstanding the load conditions of a compressor at the location where the compressor mounting base plate is installed; and thus, preventing deformation of the compressor mounting base plate such as when a heavy compressor is affixed to the compressor mounting base plate.

Another object of the present invention is to provide a compressor mounting base plate structure having improved impact resistance.

The lower portion of a conventional refrigerator typically includes a machine compartment casing (also referred to as a "machine room") made of metal; a conventional compressor made of metal, and a compressor mounting base plate also made of metal. Thus, the total overall weight of the refrigerator unit including the compressor and the compressor mounting base plate is typically very heavy; and the total overall manufacturing cost of the refrigerator unit is quite high. Therefore, a further object of the present invention is to provide a compressor mounting base plate structure that is light weight by fabricating the compressor mounting base plate structure with a light weight composite material. By incorporating such a light weight compressor mounting base plate structure made of composite material into a refrigerator unit, the overall weight of the refrigerator unit can be reduced.

Still another object of the present invention is to simplify the parts of a refrigerator that are disposed in the machine compartment casing located at the lower structure of the refrigerator to thereby reduce manufacturing costs and improve assembly efficiency of the refrigerator. For example, in one embodiment of the present invention the fabrication of the compressor mounting base plate structure is simplified by fabricating a single piece compressor mounting base plate structure using a simple fabrication process such as a pultrusion process, wherein the fabrication costs for fabricating the compressor mounting base plate structure and a refrigerator are reduced.

The present invention compressor mounting base plate structure may be advantageously used as part of a machine compartment casing of a refrigerator wherein the compressor mounting base plate engages the lower portion of a conventional refrigerator and wherein the top surface of the compressor mounting base plate defines the bottom portion of the machine compartment casing of the refrigerator.

With reference to FIGS. 6-11, there is shown one embodiment of a compressor mounting base plate of the present invention made using a pultrusion process. The compressor mounting base plate structure (herein referred to as "the base plate") includes an elongated, non-metal, non-corrosive structure. The base plate of the present invention, shown in FIGS. 6-11, is generally indicated by reference numeral 40. The base plate 40 can also be referred to as a tray member (or a pan member).

The base plate 40 includes a combination of a middle or central base plate section or segment, generally indicated by numeral 50; and a structural reinforcement means made up of a first and second reinforcing sections generally indicated by numerals 60A and 60B, respectively. The first and second reinforcing sections 60A and 60B are integrally connected to the base plate segment 50 and are disposed transverse to the longitudinal length of the base plate segment 50 at the proximal and distal ends of the base plate segment 50. The structural reinforcement means made up of the first and second reinforcing sections 60A and 60B are adapted to provide at least a dual purpose including: (1) providing reinforcement for the base plate 40, and (2) receiving and removably affixing wheel members to the base plate 40 (For example, a wheel member 72 is shown in dotted lines in FIG. 8).

Optionally, in another embodiment a supplemental structural reinforcement means made up of third and fourth supplemental reinforcing sections (not shown) are generally disposed along the longitudinal sides of the base plate segment 50 and integrally connected to the base plate segment 50 and/or integrally connected to the reinforcing sections 60A and 60B as described herein.

Figure 6:
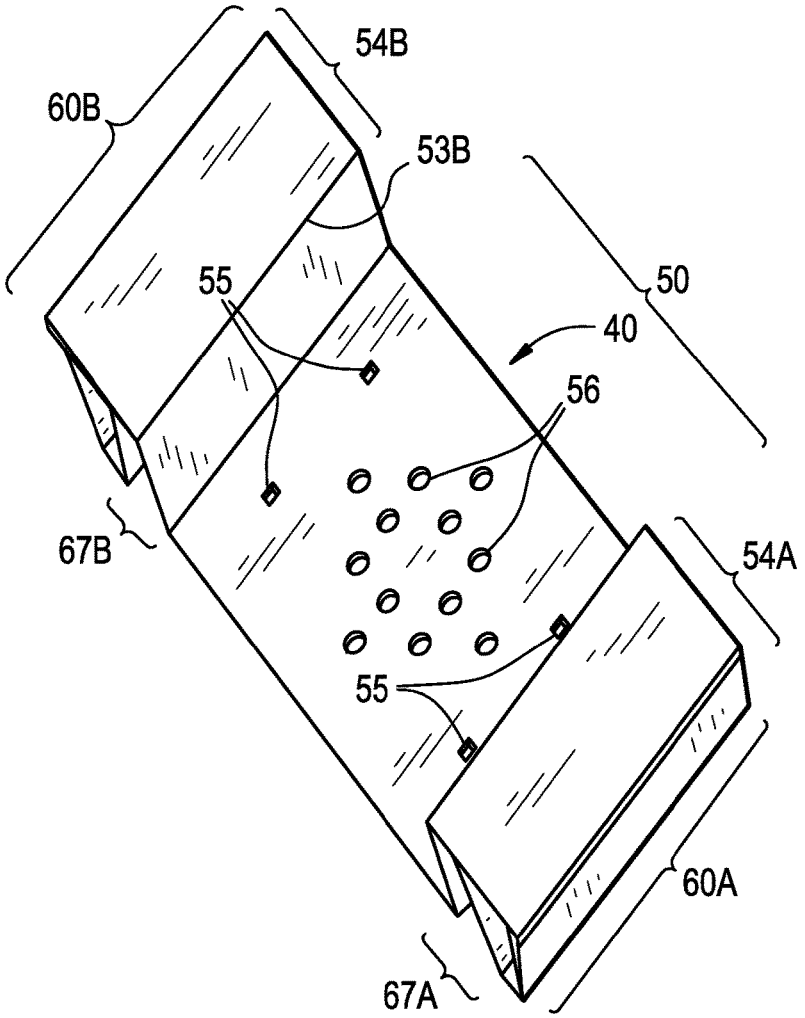
FIG. 6 is a perspective view of one embodiment of a compressor mounting base plate of the present invention.
Figure 7:
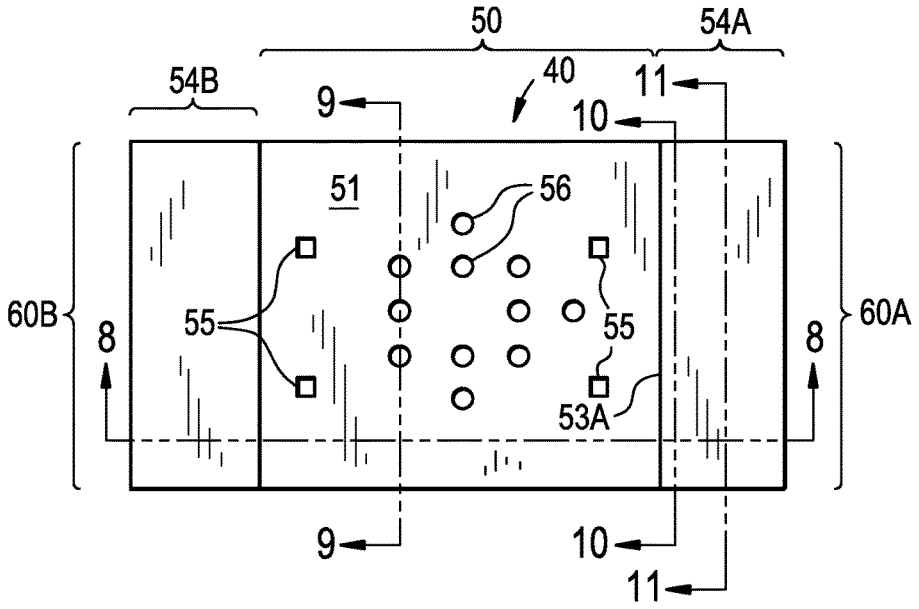
FIG. 7 is a top view of the compressor mounting base plate of FIG. 6.
Figure 8:
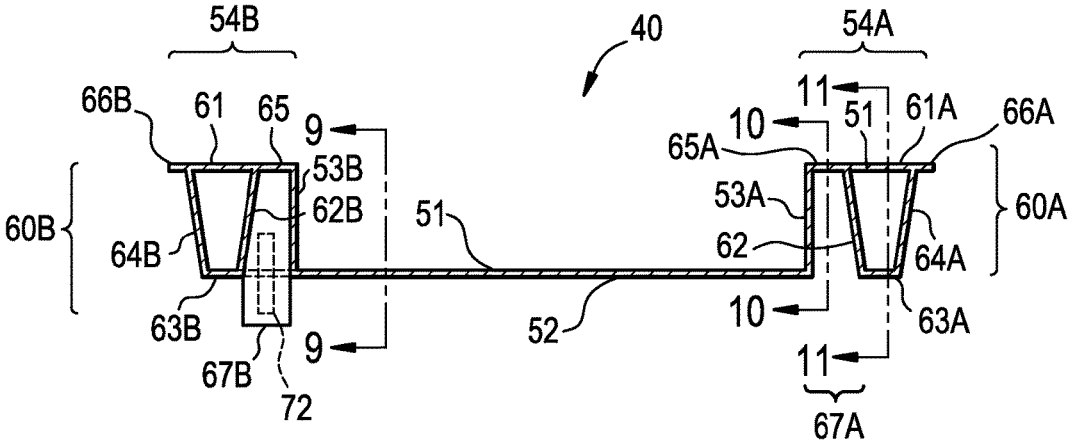
FIG. 8 is a cross-sectional view taken along line 8-8 of FIG. 7.
Figure 9:
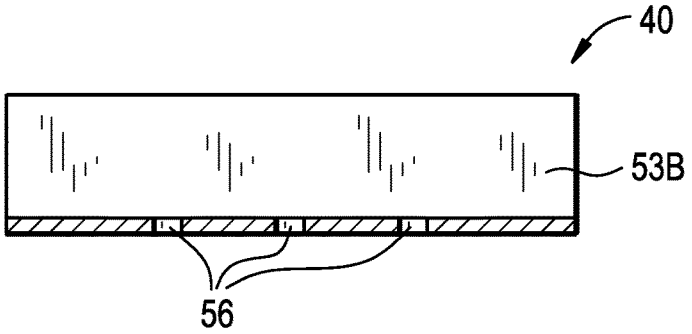
FIG. 9 is a cross-sectional view taken along line 9-9 of FIG. 7.
Figure 10:
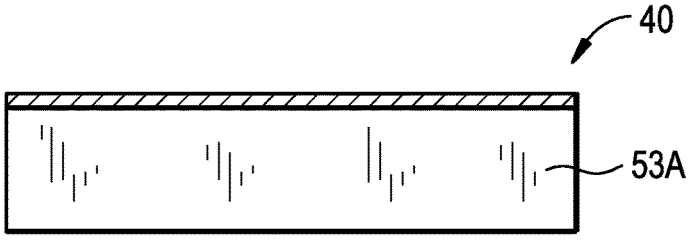
FIG. 10 is a cross-sectional view taken along line 10-10 of FIG. 7.
Figure 11:
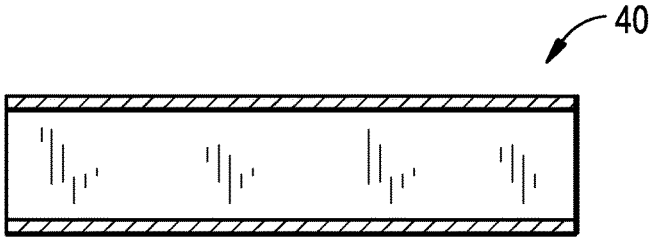
FIG. 11 is a cross-sectional view taken along line 11-11 of FIG. 7.
Figure 12:
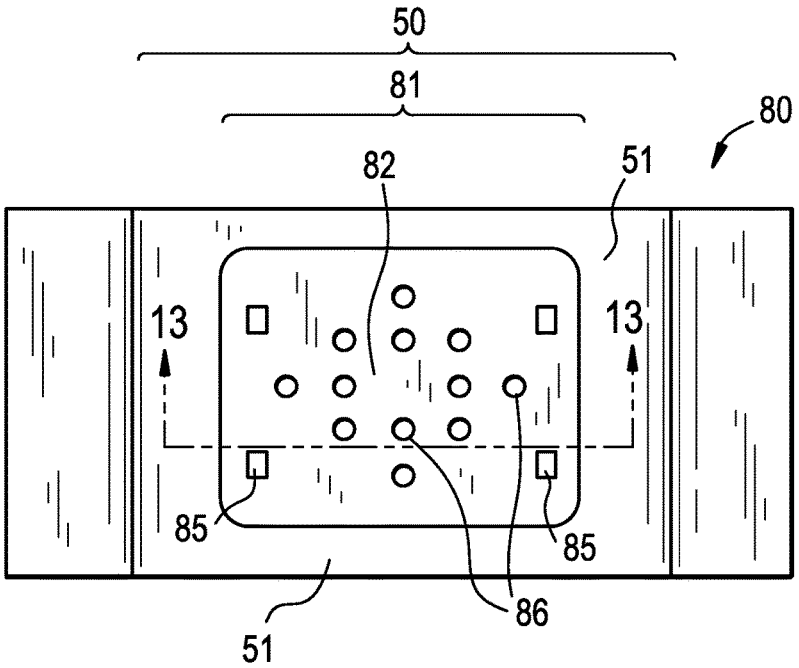
FIG. 12 is a top view of a portion of another embodiment of a compressor mounting base plate structure of the present invention.
Figure 13:
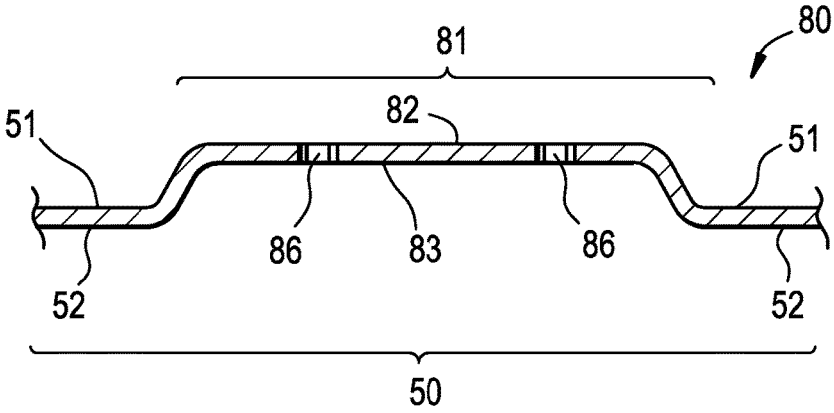
FIG. 13 is a cross-sectional view of a portion of the base plate segment of the compressor mounting base plate structure of FIG. 12 taken along line 13-13.

In one embodiment, the base plate segment 50, as shown in FIGS. 6-8, is a generally flat or substantially planar base plate; and has a top surface 51 and a bottom surface 52. In another embodiment, the base plate segment 50 of the present invention can include, as an optional structural element, at least one load bearing/load distributing structure member integral with the base plate segment 50 and adapted for providing additional strength, reinforcement and integrity to the base plate. For example, with reference to FIGS. 12 and 13, there is shown a base plate 80 having a load bearing/load distributing structure which can be, in this instance, a raised surface area portion 81 in at least a portion of the base plate segment 50 of the base plate 80. The raised area 81 has a top surface 82 and a bottom surface 83. The top surface 82 of the raised area 81 is adapted for receiving a compressor (not shown) via orifices 85 as shown in FIGS. 12-13 and nuts and bolts (not shown) for affixing the compressor to the raised area 81; the orifices 85 can be similar to the orifices 55 of FIGS. 6 and 7. The venting orifices 86 of the raised area 81, shown in FIGS. 12-13, can be similar to the orifices 56 of FIGS. 6-7.

The base plate segment 50 is adapted for receiving and removably affixing a compressor (not shown in FIG. 6, however, the compressor of the present invention may be similar to a conventional compressor 13 shown in FIGS. 1 and 2) to the base plate segment 50 of the base plate 40. As aforementioned, the base plate segment 50 shown in FIGS. 6-8, is a generally flat or substantially planar base plate; and has a top surface 51 and a bottom surface 52. In addition, the planar base plate segment 50 includes vertical sidewall members 53A and 53B integral with the base plate segment 50. The vertical sidewall members 53A and 53B are generally at about a 90 degree angle or generally perpendicular to the horizontal plane of the top surface 51 of the base plate segment 50; and integral with the base plate segment 50 on each transverse end of the base plate planar segment 50. Although the vertical sidewall members 53A and 53B are shown in FIG. 8 as being about at a 90 degree (°) angle or generally perpendicular to the horizontal plane of the top surface 51 of the base plate segment 50, the sidewalls 53A and 53B can be disposed at an increased angle from vertical so as to open the top surface 51 of the base plate segment 50 and to receive the compressor. For example, the angle of the sidewall members 53A and 53B can be in the range of from about 90° to about 135° in one embodiment, from about 90° to about 125° in another embodiment, and from about 90° to about 105° in still another embodiment.

The base plate 40 also includes generally horizontal elongated ledges 54A and 54B integral with the sidewalls 53A and 53B, respectively, near or at the top edge of the vertical sidewalls 53A and 53B, respectively. The horizontal ledges 54A and 54B are integral with the sidewalls 53A and 53B, respectively, generally at about a 90 degree angle or generally perpendicular to the vertical plane of the sidewalls 53A and 53B, respectively, of the base plate segment 50. In other embodiments, the horizontal ledges 54A and 54B can be disposed at a different angle from the vertical plane of the sidewalls 53A and 53B. For example, the angle of the horizontal ledges 54A and 54B can be in the range of from about 45° to about 135° in one embodiment, from about 75° to about 105° in another embodiment, and from about 80° to about 100° in still another embodiment. In a preferred embodiment, the horizontal ledges 54A and 54B are perpendicular to the vertical plane of the sidewalls 53A and 53B.

The base plate segment 50 is adapted for receiving the compressor, and the compressor can be removably mounted or removably affixed to the top surface 51 of the base plate segment 50 via a means for mounting/affixing the compressor to the top surface 51 of the planar base plate segment 50 including for example one or more orifices 55 disposed in the body of the planar base plate segment 50, and wherein the orifices 55 are adapted for receiving the means for mounting/affixing the compressor. For example, with reference to FIGS. 6-8 again, there is shown a means for receiving and removably mounting or affixing a compressor to the top surface 51 of the planar base plate segment 50 which includes orifices 55 shown in FIGS. 6-7 in the planar base plate segment 50. The orifices 55 are adapted for receiving and removably mounting or affixing a compressor to the top surface 51. Generally, the means for mounting/affixing the compressor to the base plate segment may be generally disposed toward the middle or central portion of the planar base plate segment 50.

In addition to the one or more orifices 55, the means for receiving and removably mounting or affixing a compressor to the base plate segment 50 of the present invention includes for example threaded bolts (not shown in FIG. 6, however, the threaded bolt of the present invention may be similar to a conventional bolt 31 shown in FIG. 3) for inserting through the orifice 55; and threaded nuts (not shown in FIG. 6, however, the threaded nut of the present invention may be similar to a conventional threaded nut 32 shown in FIG. 3) for securing the threaded nut. The threaded bolt can be inserted through the orifice 55 from the bottom surface 52 of the planar segment 50 to the top surface 51 of the planar segment 50 and secured with the threaded nut. The threaded nuts are used for engaging and locking the threaded bolts in place; and to secure the compressor on the base plate via support mounting brackets (not shown in FIG. 6, however, the brackets of the present invention may be similar to conventional support mounting brackets 16 shown in FIGS. 1 and 2) attached to the compressor.

Figure 2:
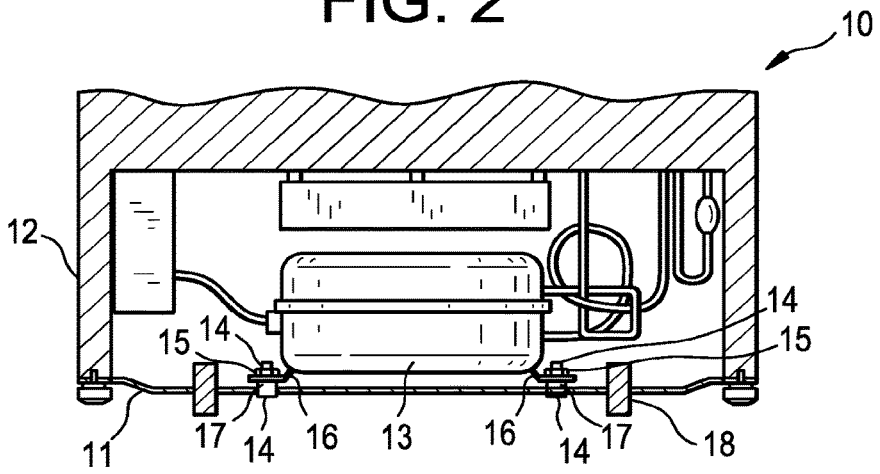
FIG. 2 is a front view, partly in cross-section, of the back side lower portion of the refrigerator of FIG. 1 showing the machine compartment of the refrigerator according to the conventional art.
Figure 3:
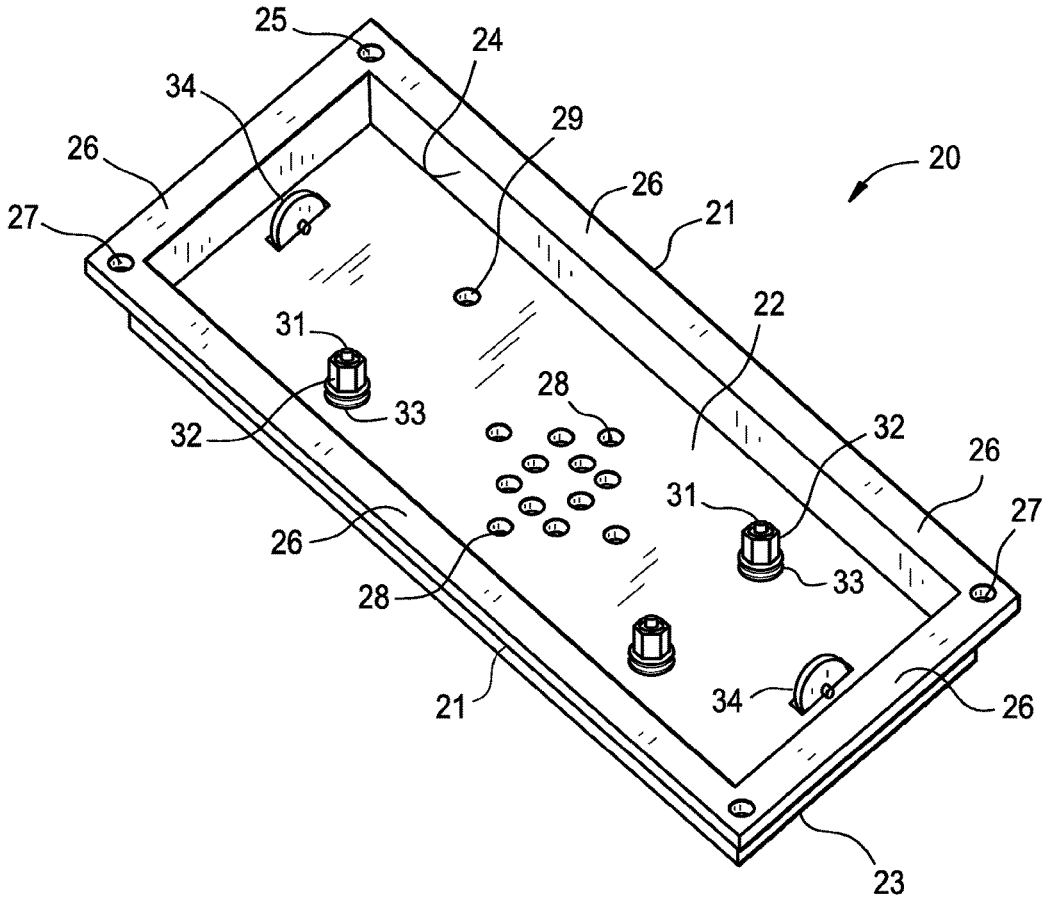
FIG. 3 is a perspective view of another embodiment of a steel compressor mounting plate of the prior art adapted to being installed in a refrigerator.
Figure 4:
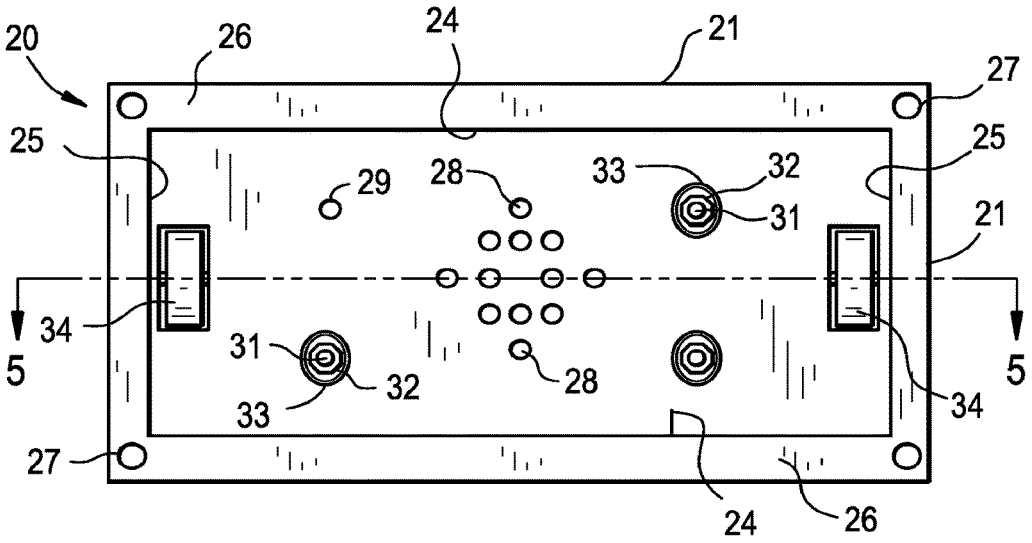
FIG. 4 is a top view of the prior art steel compressor mounting plate of FIG. 3.
Figure 5:
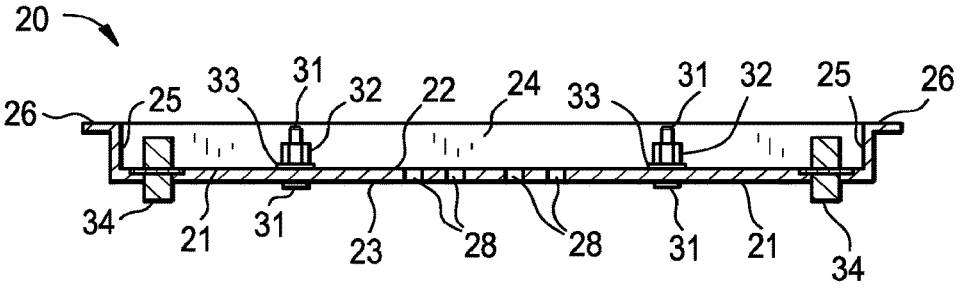
FIG. 5 is a cross-sectional view of the prior art steel compressor mounting plate taken along line 5-5 of FIG. 4.

Inserted in-between the support mounting bracket members attached to the compressor and the top surface 51 of the planar segment 50 is one or more vibration damper members (not shown in FIG. 6, however, the vibration damper members of the present invention may be similar to conventional dampers 17 shown in FIGS. 1 and 2). Generally, the vibration damper members are made of rubber, and used to dampen the vibrations caused by the operation of the compressor. The compressor can be removably affixed to the top surface 51 of the planar segment 50 via threaded nuts and bolts inserted through orifices 55 in the planar segment 50 (see FIGS. 1-5 for similar orifices, nuts and bolts).

With reference to FIGS. 6-11 again, there is shown one embodiment of the at least two elongated transverse reinforcement segments 60A, 60B integral with the base plate segment 40 near the proximal and distal ends of the base plate segment 40. For example, the elongated transverse reinforcement segments 60A, 60B, herein referred to as at least a first reinforcing structure member 60A and at least a second reinforcing structure member 60B, respectively. Each of the reinforcing structure members 60A and 60B comprise an elongated top ledge portion 61A, 61B, a first elongated angled sidewall portion 62A, 62B, elongated bottom ledge portion 63A, 63B, and a second elongated angled sidewall portion 64A, 64B as shown in FIG. 8. The first and second reinforcing structure members 60A, 60B are disposed integrally with the base plate segment 50 via the horizontal ledges 54A and 54B, respectively—one reinforcing structure member 60A is disposed coterminous with horizontal ledge 54A and the other reinforcing structure member 60B is disposed coterminous with horizontal ledge 54A. The first and second reinforcing structure members 60A, 60B are disposed transverse to the base plate planer segment 50, in parallel to each other, and in mirror image with each other on opposite ends of the longitudinal length of the base plate planer segment 50.

The at least two elongated reinforcement sections or segments 60A and 60B of the base plate 40 are integral with the planar segment 50 at the extreme ends (proximal and distal ends) of the planar segment 50 via the horizontal ledges 54A and 54B by being integrally attached to the bottom surface of the horizontal ledges 54A and 54B wherein a portion of the horizontal ledges 54A and 54B form the elongated top ledge portion 61A, 61B of the reinforcement segments 60A and 60B, respectively. The reinforcement segments 60A and 60B are adapted for reinforcing the base plate 40. The elongated reinforcement segments 60A and 60B advantageously provide the base plate 40 with increased strength and rigidity sufficient for the base plate 40 to withstand a deformation load from the heavy weight of a compressor. Typically, a compressor is made of steel and can be very heavy such as weighing up to 2 kg.

In the embodiment shown in FIGS. 6-11, the first reinforcing structure member 60A and the second reinforcing structure member 60B, are shown as trapezoidal-shaped tubular members, when viewed in a cross-sectional side view at the extreme ends of the members 60A and 60B. For example, FIG. 8 shows the trapezoidal-shaped tubular members 60A and 60B in cross section. As aforementioned, the trapezoidal-shaped tubular members 60A and 60B comprise an elongated top ledge portion 61A, 61B, an elongated angled sidewall portion 62A, 62B, an elongated bottom ledge portion 63A, 63B and an elongated angled sidewall portion 64A, 64B, each portion 61-64 being integral with each other. The first reinforcing structure member 60A comprising a trapezoidal-shaped tubular member is disposed at one transverse end of the planar segment 50 and the second reinforcing structure member 60B comprising a trapezoidal-shaped tubular member is disposed at the other transverse end of the of the planar segment 50, i.e., member 60A and member 60B are parallel and in mirror image to each other.

The first reinforcing structure member 60A and the second reinforcing structure member 60B are integral with the planar segment 50 via the horizontal ledges 54A and 54B, respectively. In FIGS. 6-11, the planar segment 50 is shown generally as rectangular in shape with the reinforcing structure members 60A and 60B integral with the planar segment 50 and the vertical sidewall members 53A and 53B on each transverse end of the planar segment 50. The planar segment 50 and the vertical sidewall members 53A and 53B form a general U-shaped member viewed in cross section as shown in FIG. 8. Although the base plate segment 50 is shown as a rectangular-shaped member, the overall shape of the base plate segment 50 is not limited to a rectangle, but may include any shape desired that meets the requirements for use as a compressor mounting base plate and receiving a compressor such as a compressor for a refrigerator unit including shapes such as an oval, a triangle, a pyramid, a square, and the like.

In addition, the trapezoidal-shaped tubular members 60A, 60B can be structured in another shape that is conducive to and facilitates the fabrication of the compressor mounting base plate structure of the present invention using, for example, a pultrusion process. However, the shape of the first and second reinforcing structure members 60A, 60B is not limited to a trapezoidal-shaped tubular member viewed in cross section, but may include any shape desired that meets the requirements for reinforcing the base plate and for functioning in appliance equipment where the base plate is used, such as a refrigerator unit. Each one of the reinforcing structure members 60A, 60B, therefore, can be any shape that provides the required strength to the base plate 40. For example, in one embodiment, each of the reinforcing structure members 60A, 60B, can comprise a hollow elongated tubular member in the shape of a trapezoid, triangle, an oval, rectangle, pyramid, square and the like integral with the planar segment 50. In another embodiment, for example each of the reinforcing structure members 60A, 60B, can comprise a solid elongated bar or rib in any of the aforementioned shapes and integral with the planar segment 50. In general, the reinforcing structure members 60A, 60B of the present embodiment shown in FIG. 8 are trapezoidal-shaped tubular members and open at both ends of the tubular member in order to simplify the fabrication process via pultrusion and to minimize fabrication costs.

In the embodiment shown in FIGS. 6-11, the horizontal ledges 54A and 54B are coterminous with a portion 65A, 65B, a portion 61A, 61B, and an extended ledge portion 66A, 66B comprising the horizontal ledges 54A and 54B, respectively. The reinforcing structure members 60A, 60B are integral with the horizontal ledges 54A and 54B, respectively. The reinforcing structure members 60A and 60B are also spaced apart a short predetermined distance from the vertical sidewall members 53A and 53B, respectively, to form a space between the elongated angled sidewall portion 62A, 62B and the sidewall 53A, 53B. This space, generally indicated by numeral 67A, 67B can be utilized to incorporate a wheel member and a wheel member mounting means such as a wheel member described herein below (For example, a wheel member 72 is shown in dotted lines in FIG. 8). The space 67A, 67B, as shown in FIG. 8, generally forms an upside down U-shaped portion when viewed in cross-section. For example, the upside down U-shaped portion 67A includes (1) a portion of the horizontal ledge 54A indicated by numeral 65A; (2) the outer surface of the sidewall 53A; and (3) the outer surface of the sidewall portion 62A of the reinforcing structure members 60A. And, for example, the upside down U-shaped portion 67B includes (1) a portion of the horizontal ledge 54B indicated by numeral 65B; (2) the outer surface of the sidewall 53B; and (3) the outer surface of the sidewall portion 62B of the reinforcing structure members 60B.

In addition, optionally the compressor mounting base plate structure 40 can include a means (not shown) for removably attaching the compressor mounting base plate to the machine compartment casing of the lower portion of a refrigerator unit. The removable attachment means can be for example one or more nuts and bolts removably affixed through an orifice (not shown) on the elongated top extended ledge portions 66A, 66B of the first and second reinforcing structures. The ledge portions 66A, 66B of the first and second first reinforcing structure members are adapted to contain such means for attaching the compressor mounting base plate structure, for example, to the lower portion of the refrigerator unit.

The base plate 40 of the present invention can optionally include a structural means, integral with the base plate 40, adapted for receiving and removably attaching a means for moving the refrigerator unit to its location of operation, once the base plate 40 is affixed to the lower portion of the refrigerator unit; and for moving the base plate 40 to and from the machine compartment case at the lower portion of a refrigerator unit during installation of the base plate 40 to the refrigerator unit.

In one embodiment, the structural means adapted for receiving and removably attaching a means for moving the refrigerator unit can be for example the spaces 67A, 67B. The spaces form the upside down U-shaped structure for receiving, accommodating, and incorporating a wheel member and a wheel member mounting means such as a wheel member described herein below (For example, a wheel member 72 is shown in dotted lines in FIG. 8).

The means for moving the refrigerator unit removably attached to the base plate 40 structure includes as one example, at least two or more wheel members. One of the wheel members (not shown) can be removably attached to the base plate 40 at space 67A and the other of the wheel members 72 can be removably attached to the base plate 40 at space 67B (Only one wheel member 72 is shown in dotted lines in FIG. 8 for illustration purposes but is understood to the skilled artisan that another wheel member similar to wheel member 72 can be included in space 67A.). In a preferred embodiment, wheels are provided near the proximal and distal ends of the base plate 40. The wheels attached to the base plate 40 provide a means for easily moving the refrigerator with base plate into position for use.

In FIGS. 6-11, the base plate 40 is shown without a sidewall or reinforcing member along either of the longitudinal sides of the base plate 40; i.e., the two longitudinal sides of the base plate 40 are open. However, optionally, the base plate 40 may include one or more additional or supplemental reinforcement means along the longitudinal sides of the base plate 40. For example, in one embodiment (not shown), the base plate 40 can include an additional or supplemental reinforcement means comprising reinforcing sections being disposed longitudinal along the horizontal plane of the base plate segment 50. Supplemental reinforcement means can be used to provide further reinforcement to the base plate 40.

Each one of the optional supplemental reinforcing sections of the present invention may comprise a planar reinforcing strip member of a predetermined width, one strip member disposed at one side of the base plate 40 and the other strip member disposed along the other side of the base plate 40. The supplemental reinforcing sections can be integral with the base plate segment 50 and, when used, can also be integral with reinforcing sections 60A and 60B. The supplemental reinforcing sections can advantageously provide the base plate 40 with further increased strength and rigidity, which allows the base plate 40 to withstand deformation load from the weight of a compressor when said compressor is heavy weight such as 6-9 kg.

Each of the supplemental reinforcing sections may comprise a longitudinal strip member structure of a predetermined shape integral with the sides of the base plate 40 which advantageously provide the base plate 40 with added structural stability such as torsion rigidity and bending rigidity to the base plate 40 in the longitudinal direction of the base plate 40.

The base plate segment 50, shown in FIGS. 6-11, may optionally contain one or more venting orifices 56 for allowing air to pass through the orifices 56 and to circulate throughout the machine compartment casing of a refrigerator unit; and/or to allow drainage of any standing water on the top surface 51 of the base plate segment 50. For example, as shown in FIGS. 6 and 7, a plurality of orifices 56 are disposed generally in the central or middle portion of the base plate segment 50. With reference to FIGS. 12 and 13, orifices 86 of the raised portion 81 function similar to the orifices 56.

In another embodiment, the base plate 40 of the present invention shown in FIGS. 6-11, optionally can include a means for receiving and retaining liquid condensation (not shown) that may occur in the machine compartment casing of a refrigerator unit during operation of the refrigerator unit.

For example, the means for receiving and retaining liquid condensation may comprise a dip tray member (not shown) either integral with the base plate 40; or removably attached to the top surface 51 of the base plate segment 50 of the base plate 40. As aforementioned, the dip tray member is adapted for collecting a liquid; for example the drip tray can be used to capture and collect water formed through condensation or other liquid in the machine compartment of the refrigerator unit.

Generally, in one embodiment of the present invention, the compressor mounting base plate structure can be a one-piece body member made of a non-metal, corrosion resistant synthetic resin or composite material. For example, the composite material can be a synthetic thermosetting resin material such as a polyurethane polymer resin, an epoxy resin, or a polyester resin. In a preferred embodiment, the one-piece body member can be made from curable composition including a combination of (a) a synthetic thermosetting resin matrix binder material and (b) a reinforcement material. Generally, the curable composition is prepared by admixing a thermosetting resin material a curing agent to form the binder material; and then a reinforcing material is added to the binder material.

A wide variety of reinforcement materials can be suitable for use in producing the compressor mounting base plate structure. In one preferred embodiment, a fiber reinforcement material is used. For example, fiber reinforcing materials may include woven fibers, non-woven (random) fibers, or a combination thereof.

Examples of suitable reinforcing fibers useful for the curable composition or formulation may be selected from fibers, such as for example but not limited to, mineral or ceramic fibers such as Wollastonite, aluminum, glass fibers, carbon fibers and the like; synthetic fibers of nylon, polyester, aramid, polyether ketones, polyether sulfones, polyamides, silicon carbon, and the like; natural fibers such as cellulose, cotton, hemp, flaxes, jute and kanaf fibers; metal fibers; and mixtures thereof. Biocomponent fibers such as a non-glass material spun bonded non-woven having a polyester core and polyamide skin, may also be used.

Glass fiber, either woven or non-woven, such as fiber made from E-glass and S-glass, is the preferred reinforcement material used in the present invention due to its low cost and physical properties. Typically, the reinforcing fibers have an average length of at least 1.00 mm. The reinforcing fibers also typically have a diameter of between about 5 and about 20 microns. The fibers may be used in the form of chopped strands or individual chopped filaments.

The matrix binder useful in the present invention for the composition or formulation for constructing the composite body defining the compressor mounting base plate structure may be a thermoset polymer or a thermoplastic polymer. Typically the matrix binder is selected from a group of materials consisting of polyolefins, polyesters, polyamides, polypropylene, copolymers of polyethylene and polypropylene, polyethylene, nylon 6, nylon 66, high heat nylons, copolymers of nylon 6, nylon 66 and high heat nylons, polycarbonate/acrylonitrile butadiene styrene blend, styrene acrylonitrile, polyphenylene sulfide, polyvinyl chloride, polybutylene terephthalate, polyethylene terephthalate, polyurethane, epoxy, vinyl ester, phenolic compound, dicyclopentadiene and mixtures thereof. The matrix binder may be used in liquid form, powder form, pellet form, fiber form and/or bi-component fiber form. The physical form of these matrix materials (i.e., their viscosities, particle sizes, etc.) is well-known in the art, variable to be compatible with the particular pultrusion process chosen to fabricate the composite, and typical of "standard" matrix materials known in the industry.

Generally, the composite body comprises between about 20 weight percent (wt %) and about 50 wt % reinforcing fibers and between about 50 wt % and about 80 wt % matrix binder. In one embodiment, the composite body has a density of between about 1.0 g/cm$^3$ and about 2.0 g/cm$^3$.

In a preferred embodiment, a polyurethane-isocyanate composition can be used in the present invention as the synthetic material binder matrix with various reinforcement materials to produce the compressor mounting base plate structure.

There may be several methods used for forming the curable formulation or composition for preparing the base plate 40. For example, in one embodiment, the curable composition is prepared by mixing a thermosetting resin matrix material and the fiber reinforcement material described above. In addition, the preparation of the binder resin matrix and reinforcement material composition or formulation of the present invention, and/or any of the steps thereof, may be a batch or a continuous process. The mixing equipment used in the process may be any vessel and ancillary equipment well known to those skilled in the art.

In general, the composition for fabricating the compressor mounting base plate structure according to an exemplary embodiment of the present invention can be formed by mixing the synthetic resin matrix material and the reinforcement material such as reinforcing fibers arranged to be processed according to a pultrusion process described herein below. That is, the compressor mounting base plate structure may be fabricated by combining the reinforcing fibers with the resin matrix material.

In a preferred embodiment, the compressor mounting base plate composite article of the present invention which is useful in refrigerators can be made of a synthetic resin through the use of, for example, a pultrusion process. In the present invention, a most suitable preferred embodiment is to form the compressor mounting base plate structure by using a pultrusion process in order to maximize the strength of the compressor mounting base plate structure and reduce the fabrication costs of the compressor mounting base plate structure.

For example, as is well known in the art, pultrusion is the process of "pulling" raw composite material, such as fiberglass and resin, through a shaped heated die creating a continuous composite profile. The profile that exits the die is a cured pultruded Fiber Reinforced Polymer (FRP) composite. In a preferred embodiment, a pultrusion process can be used in the present invention to fabricate the compressor mounting base plate in a pultruded one-piece body made of a non-metal, corrosion resistant composite material. The pultrusion process uses glass fiber and a thermosetting resin to make a structurally strong composite. A pultrusion process useful in the present invention is described for example in U.S. Pat. No. 7,056,796; incorporated herein by reference.

A typical pultrusion process includes, for example, the following general steps:

Step (1): A reinforcement material in the form of raw fiber (e.g., glass, carbon, aramid, or mixtures thereof) is pulled off of doffs or rolls from a creel racking system.

Step (2): The raw fiber being pulled off the racks in Step (1) are guided through a resin bath or resin impregnation system. The resin bath includes the raw resin matrix composition comprising a thermosetting resin, optionally combined with fillers, catalysts, pigments and other additives. The resin can be polyester resin, vinyl ester, epoxy or urethane as described above. As the fibers are passed through the resin bath, the fibers become fully impregnated (wetted-out) with the resin matrix such that all the fiber filaments are thoroughly saturated with the resin mixture.

Step (3): Using guiding systems, the impregnated fibers of Step (2) are led through a heated die. The entrance of the heated die is often cooled to avoid curing the resin while excess resin is squeezed off.

Step (4): As the fiber and resin is pulled through the heated die in Step (3), the resin cures and exits as a fully formed composite. The shape of the pultruded composite part will match the shape of the die. The profile that exits the die is a cured pultruded profile which can be referred to as a Fiber Reinforced Polymer (FRP) composite. The pulling action in this process is accomplished by a set of "pullers" or "grippers" which are pulling the material at a continuous and consistent rate.

Step (5): At the end of the pultrusion process, a cut-off saw is used to cut the pultruded profiles from Step (4) to a specific desired length and then the cut pultruded profiles are stacked for delivery.

In one embodiment of the compressor mounting base plate structure as shown in FIG. 6, the above pultrusion process is used for example with a polyurethane resin and a glass fiber reinforcement to form a composite. The thickness of the composite compressor mounting base plate structure can be, for example, from about 0.5 mm to about 20 mm in one embodiment; from about 0.5 mm to about 15 mm in another embodiment, and from about 0.8 mm to about 5 mm in still another embodiment.

The compressor mounting base plate structure made of a composite material which is a thermoset material (i.e. a cross-linked product made from the formulation) of the present invention shows several improved properties over conventional steel base plates.

The resulting compressor mounting base plate structure fabricated with the present invention process can have a combination of properties that makes the base plate of the present invention superior to conventional base plates made of metal such as iron or aluminum for example in a specific strength. For example, the static stiffness of a compressor mounting base plate structure made from steel is typically about 634 N/mm, whereas the static stiffness of the compressor mounting base plate structure according to an exemplary embodiment of the present invention can be about 679 N/mm. In addition, dynamic stiffness of an exemplary embodiment of the present invention can be for example 30 Hz as its first frequency where as for a steel base plate typically the dynamic stiffness is 21 Hz under modal analysis. Accordingly, the base plate of the present invention can have the same strength as that of the existing conventional steel base plate but the weight of the base plate of the present invention can be minimized.

In a preferred embodiment, the resin matrix material used in the present invention may be epoxy or polyester in terms of costs and effectiveness. In addition, the reinforcing fibers used in the present invention may be glass fibers which are low-priced and have a suitable strength. In other embodiment, the reinforcing fibers can be other nonmetal fibers such as boron, carbon, graphite, Kevlar, and the like as described above.

The polyurethane resin and glass fiber composite material specification for the compressor mounting base plate structure made by a pultrusion process includes for example, a Young's Modulus of from about 1.0 GPa to about 100 GPa, and preferably from about 5 GPa to about 40 GPa; a Poisson's ratio of from about 0.01 to about 0.4 and preferably from about 0.1 to about 0.35 and a density of from about 500 $Kg/m^3$ to about 4000 $Kg/m^3$ and preferably from about 800 $Kg/m^3$ to about 2500 $Kg/m^3$.

The composite compressor mounting base plate structure of the present invention also exhibits other advantageous properties. For example, the tensile strength of the base plate can be from about 70 MPa to about 900 MPa in one embodiment; and from about 500 MPa to about 770 MPa in another preferred embodiment, as measured by the test method DIN EN ISO 527 (2012).

The flexural modulus of the base plate can be from about 3.5 GPa to about 40 GPa in one embodiment; and from about 10 GPa to about 34 GPa in another preferred embodiment, as measured by the test method DIN EN ISO 178 (2011).

Also, the % elongation of the base plate can be from about 1% to about 7% in one embodiment; and from about 1% to about 2.5% in another preferred embodiment, as measured by the test method DIN EN ISO 527 (2012).

Base plates made of polyurethane composite material exhibits better/excellent damping properties over base plates made of steel, providing vibration absorption characteristics transmitted by a compressor. For example, the damping increase of a composite material of the present invention base plate over steel can be generally from about 50% to about 900% in one embodiment, and from about 300% to about 700% in another embodiment.

The composite product which is a thermoset product (i.e. a cross-linked product made from the above-described formulation) of the present invention shows several improved properties over conventional products.

For example, the pultruded compressor mounting base plate structure of the present invention, which can be a composite product of polyurethane resin and glass fiber composite material, may have a glass transition temperature (Tg) generally from about 80° C. to about 150° C. in one embodiment; and from about 100° C. to about 120° C. in another embodiment. The Tg may be measured using a differential scanning calorimeter by scanning at 10° C./minute. The Tg can be determined by the inflection point of the $2^{nd}$ order transition.

The composite system of the present invention is used to prepare a compressor mounting plate for an appliance device, particularly a refrigerator. For example, the compressor mounting base plate structure of the present invention is advantageously used in a refrigerator unit wherein the base plate structure is installed in the machine compartment of the refrigerator. To achieve the advantages in accordance with the purpose of the present invention, as embodied and broadly described herein, in general, there is provided a refrigerator including: (a) a refrigerator main body having a cooling chamber for storing foods; (b) a machine compartment; (c) a compressor mounting base plate structure installed in the machine compartment located at a lower portion of the refrigerator main body; said compressor mounting base plate structure adapted for receiving and supporting a compressor; and (d) a compressor mounted on the compressor mounting base plate structure. The compressor mounting base plate structure engages the machine compartment forming the bottom structure of the machine compartment casing and together with the lower portion of the refrigerator main body, the top surface of the base plate defines the machine compartment of the refrigerator.

Generally, a refrigerator is comprised of: a main body having a cooling chamber such as a freezing chamber and a refrigerating chamber therein; and a machine compartment positioned at a lower portion of a rear side of the main body and having various components forming a refrigeration cycle such as a compressor for compressing a refrigerant. Other parts of the refrigerator may include, for example, a control box for controlling the refrigeration cycle installed inside of the machine compartment and a separate water tray installed inside of the machine compartment for storing water generated from the refrigeration cycle by a defrosting operation.

The compressor mounting base plate structure of the present invention is mounted on a lower bottom portion of the machine compartment; and a compressor is mounted on the compressor mounting base plate structure. The compressor mounting base plate structure is affixed to the lower portion of the main body by any attachment which can be removable such as mounting brackets and one or more nuts and bolts.

In the present invention, the compressor can be installed on the compressor mounting base plate structure by mounting bracket system including a support bracket, a vibration preventing rubber member removably attached to the mounting bracket for preventing vibration generated from the compressor from being transferred to the main refrigerator body; and nuts and bolts to firmly affix the compressor to the base plate structure.

When the refrigerator containing the compressor mounting base plate structure of the present invention is constructed and operated as aforementioned the improved described above can be achieved.

EXAMPLES

The following example further illustrate the present invention in detail but is not to be construed to limit the scope thereof.

The following materials are used in the Example:

VORAFORCE TP 203 is a diglycidylether of bisphenol-A type of epoxy resin and commercially available from The Dow Chemical Company.

VORAFORCE TP 253 is an epoxy hardener composition including a combination of (i) tetrahydro-4-methylphthalic anhydride (80%-90%), (ii) 1,2,3,6-tetrahydrophthalic anhydride (10%-20%), and (iii) benzyltriethylammonium chloride (<2%); and commercially available from The Dow Chemical Company.

VORAFORCE TC 3000 is an accelerator, 1-methylimidazole, and commercially available from The Dow Chemical Company.

Example 1

An example of a fiber-reinforced composite of an elongated non-metal, non-corrosive compressor mounting base plate structure for a refrigerator unit in accordance with the present invention can be prepared as follows:

A. Curable Composition or Formulation

A curable epoxy resin composition is prepared by mixing 100 parts by weight (pbw) of VORAFORCE TP 203; 85 pbw of VORAFORCE TP 253; and 0.5-1.5 pbw of VORAFORCE TC 3000.

B. Pultrusion Procedure

The above epoxy resin composition is then used in a pultrusion process to fabricate a fiber-reinforced composite of an elongated non-metal, non-corrosive compressor mounting base plate structure for a refrigerator unit in accordance with the present invention as follows:

Pultrusion is a closed reactive process in which reinforcement materials comprising reinforcing fibers such as glass fibers, carbon fibers, aramid fibers, and polyester fibers can be used. The forms of the fiber reinforcement material can include for example rovings (tows, for carbon fiber), stitched rovings in different orientations, continuous strand mat, chopped strand mat, woven rovings, and bulk rovings. The fibers are pulled from a series of creels through an injection box, where the fibers are thoroughly mixed (impregnated) with a polyurethane resin or another typical resin useful in a pultrusion process. The other resins useful in the present invention can include for example a resin selected from the group consisting of polyesters, vinyl esters, PVC, epoxies, phenolics, urethanes and blends thereof.

Once the reinforcing fibers are impregnated with the resin, the impregnated resin/fiber material is passed through a heated steel die. The steel die is heated generally to a temperature range from about 80° C. to about 150° C. In the heated steel die, the resin matrix is shaped to the desired structure such as the shape of the compressor mounting base plate structure shown in FIGS. 6-11; and then the shaped structure is cured to form a "profile". The profile is continually pulled through the die until the profile exits the die. Upon exiting the die, the profile is cooled and then cut to the desired length which can be generally in the range of from 200 mm to about 750 mm.

The invention claimed is:

1. An elongated non-metal, corrosion resistant compressor mounting base plate structure comprising: (I) a base plate segment having a top surface and a bottom surface, wherein the base plate segment is adapted for receiving a compressor on the top surface of the base plate; (II) one or more orifices for receiving and removably affixing a compressor to the top surface of the base plate segment; (III) a reinforcement structure integral with said base plate segment; wherein said reinforcement structure includes at least two elongated transverse reinforcement segments, comprising at least first and second reinforcing structure members integrally connected to traverse ends of the base plate segment, each reinforcing structure member comprising an elongated top ledge portion, an elongated vertical sidewall portion, an elongated bottom ledge portion and an angled sidewall portion integral with each other forming a trapezoidal-shaped elongated member; said reinforcement structure being adapted for providing the compressor mounting base plate structure with sufficient strength and rigidity such that the compressor mounting base plate structure can withstand deformation a load from the weight of the compressor; and wherein the compressor mounting base plate structure comprises a non-metal, corrosion resistant structure; and (IV) a structural component integral with the base plate adapted for removably attaching a wheel member is affixed to an appliance unit; and wherein said wheel member is adapted for moving the compressor mounting base plate structure to and from the appliance unit during installation of the compressor mounting base plate structure to the appliance unit.

2. The compressor mounting base plate structure of claim 1, wherein the base plate segment comprises a central base plate segment.

3. The compressor mounting base plate structure of claim 1, including further (V) a supplemental reinforcement compressor mounting base plate structure of claim 2, wherein the base plate segment comprises a substantially planar member having a top surface and a bottom surface; and wherein the base plate segment is adapted for receiving the compressor to the top surface of the base plate segment.

4. The compressor mounting base plate structure of claim 1, including further (V) a supplemental reinforcement compressor mounting base plate structure of claim 3, wherein the one or more orifices in the base plate segment for receiving the compressor to the top surface of the base plate segment includes therethrough a threaded bolt and a threaded nut for engaging and locking with the threaded bolt sufficient to secure the compressor on the base plate via support mounting brackets attached to the compressor.

5. The compressor mounting base plate structure of claim 2, wherein the first and second reinforcing structure members are disposed on each proximal and distal end of the transverse length of the top surface of the base plate segment such that the first and second reinforcing structure members are disposed parallel to each other on opposite ends of the transverse length of the top surface of the base plate segment.

6. The compressor mounting base plate structure of claim 5, wherein the first reinforcing structure member and the second reinforcing structure member are trapezoidal-shaped tubular members when viewed in a side view.

7. The compressor mounting base plate structure of claim 1, including further (V) a supplemental reinforcement structure comprising at least a first and second supplemental reinforcing structure members integrally connected to the base plate segment; one supplemental reinforcing structure member at each of the elongated longitudinal sides of the base plate segment generally opposite each other in mirror image and generally parallel to each other along the longitudinal plane of the base plate.

8. The compressor mounting base plate structure of claim 1, including at least one load bearing/load distributing structure integral with the compressor mounting base plate structure and adapted for providing strength, reinforcement and integrity to the mounting base plate structure.

9. The compressor mounting base plate structure of claim 8, wherein the at least one load bearing/load distributing structure is a raised surface area in at least a portion of the base plate segment adapted for receiving a compressor.

10. The compressor mounting base plate structure of claim 1, wherein the wheel member for moving the appliance unit comprises at least one or more wheel members removably attached to base plate segment.

11. The compressor mounting base plate structure of claim 1, wherein the compressor mounting base plate structure is rectangular in shape.

12. A process for manufacturing the compressor mounting base plate structure of claim 1, comprising subjecting a composite material to a pultrusion process to form a one piece compressor mounting base plate structure.

13. An appliance device comprising a compressor mounting base plate structure of claim 1.

14. A refrigerator comprising (a) a refrigerator main body having a cooling chamber for storing foods and a machine compartment;

(b) a compressor mounting base plate structure of claim 1 installed in the machine compartment of the refrigerator main body; said compressor mounting base plate structure adapted for receiving and supporting a compressor; and (c) a compressor mounted on the compressor mounting base plate structure.

15. The compressor mounting base plate structure of claim 1, including a drip tray member removably attached to the top surface of the base plate segment, said drip tray member adapted for collecting moisture and condensation.

* * * * *